US005557286A

United States Patent [19]

Varadan et al.

[11] Patent Number: 5,557,286

[45] Date of Patent: Sep. 17, 1996

[54] VOLTAGE TUNABLE DIELECTRIC CERAMICS WHICH EXHIBIT LOW DIELECTRIC CONSTANTS AND APPLICATIONS THEREOF TO ANTENNA STRUCTURE

[75] Inventors: Vijay K. Varadan, State College, Pa.; Fathi Selmi, Tunisia, Tunisia; Vasundara V. Varadan, State College, Pa.

[73] Assignee: The Penn State Research Foundation, University Park, Pa.

[21] Appl. No.: 260,053

[22] Filed: Jun. 15, 1994

[51] Int. Cl.[6] ..... H01Q 1/38

[52] U.S. Cl. ..... 343/700 MS; 343/778; 333/156; 501/137

[58] Field of Search ..... 343/700 MS, 778, 343/853; 333/156; 361/311, 320, 321; 501/137

[56] References Cited

U.S. PATENT DOCUMENTS

| | | | |
|---|---|---|---|
| 5,206,613 | 4/1993 | Collier et al. | 333/156 |
| 5,272,349 | 12/1993 | Micheli et al. | 250/338.3 |
| 5,309,166 | 5/1994 | Collier et al. | 343/778 |
| 5,312,790 | 5/1994 | Sengupta et al. | 501/137 |
| 5,334,958 | 8/1994 | Babbitt et al. | 333/156 |
| 5,386,120 | 1/1995 | Micheli et al. | 250/338.3 |
| 5,427,988 | 6/1995 | Sengupta et al. | 501/137 |

OTHER PUBLICATIONS

"Sol–Gel Processes",Reuter Advanced Materials, vol. 3, No. 5, 1991, pp. 258–259.

*Primary Examiner*—Donald T. Hajec
*Assistant Examiner*—Tan Ho
*Attorney, Agent, or Firm*—Thomas J. Monahan

[57] ABSTRACT

An improved BST dielectric powder is created used a sol-gel procedure. Addition of graphite to the powder, followed by a firing of the mixture results in a highly porous BST substrate, with the included graphite being burned off. By adjustment of the amount of added graphite, the porosity of the BST substrate is widely adjustable and enables achievement of a low bulk dielectric constant. A low dielectric filler is added to the fired substrate so as to provide a composite substrate with physical rigidity. Conductive layers are then adhered to the composite substrate to enable a tuning of the dielectric constant in accordance with applied DC voltage potentials. Antenna and other applications of the improved composite BST substrate are described.

3 Claims, 8 Drawing Sheets

VOLTAGE TUNABLE DIELECTRIC CERAMICS WHICH EXHIBIT LOW DIELECTRIC CONSTANTS AND APPLICATIONS THEREOF TO ANTENNA STRUCTURE

FIELD OF THE INVENTION

This invention relates to ferroelectric ceramic substrates, and, more particularly, to Barium, Strontium, Titanate (BST) substrates which exhibit low dielectric constants, are voltage tunable so as to enable a variation in phase shift therethrough, exhibit low loss tangents and operate in the paraelectric region.

BACKGROUND OF THE INVENTION

Phase shift components find many uses in electronic circuits. A typical phased array antenna may have several thousand radiating elements with a phase shifter for every antenna element. Ferrite phase shifters have gained popularity due to their weight, size and operational speed characteristics. However, unit cost and complexity of ferrite phase shifters have prevented their wide spread use. PIN diode phase shifters are cheaper than ferrite phase shifters, but exhibit an excessive insertion loss which limits their utility in antenna arrays. Phase shifters that employ ferroelectric materials have the potential to provide much better performance than ferrite and PIN diode phase shifters due to their higher power handling capacity, lower required drive powers and wide range of temperatures of operation.

The discovery of the ferroelectric barium titanate opened the present era of ceramic dielectrics. In such ferroelectric dielectrics, pre-existing electric dipoles, whose presence in the material is predictable from crystal symmetry, interact to spontaneously polarize sub-volumes. A ferroelectric crystal of barium-titanate generally consists of localized domains and within each domain the polarization of all unit cells is nearly parallel. Adjacent domains have polarizations in different directions and the net polarization of the ferroelectric crystal is the vector sum of all domain polarizations.

The total dipole moment of a ferroelectric crystal may be changed (i) by the movement of walls between the domains, or (ii) by nucleation of new domains. When an external electric field is applied, the domains are oriented. The effect is to increase the component of polarization in the field direction. If the applied field is lifted, some of the regions that were oriented retain the new orientation; so that when a field is applied in an opposite direction, the orientation does not follow the original path in the curve. More specifically, the crystal exhibits a hysteresis which equates to a loss function for electrical signals that propagate therethrough. Such hysteresis action occurs when the ferroelectric crystal is operated below its Curie point temperature. Above the Curie point temperature, the crystal is both isotropic and paraelectric in that it does not exhibit the hysteretic loss function. In order to reduce the hysteresis effect, others in the prior art have added dopants to the crystalline matrix to, in essence, provide a "lubricating" function at the domain boundaries which reduces the remanent polarization upon a retrace of the hysteresis curve.

Barium titanate and barium titanate-based ceramics exhibit high dielectric constants (on the order of 2,000 or more). By application of a variable voltage bias across a barium titanate crystal, substantial "tunability" (variation of the dielectric constant) can be achieved. Nevertheless, as a result of the high dielectric constant values, the use of barium titanate materials as phase shifters in microwave applications has been limited (due to a high level of mismatch with the material into which the electric waves are coupled, e.g. air). Further, because the Curie temperature of barium titanate is approximately 120° C., operation of barium titanate-based ceramics at ambient assures that they operate in the region where they exhibit the hysteresis effect-and thus exhibit the loss function associated therewith.

More recently, it has been found that the inclusion of various amounts of lead, calcium and strontium can substantially modify the Curie temperature of a barium titanate ceramic. In FIG. 1, a plot of Curie temperature versus mole percentage additions of isovalent additives lead, calcium and strontium is plotted. It is to be noted that only a strontium additive enables a substantial lowering of the Curie temperature to a level that is both at and below normal ambient operating temperatures. As a result, barium strontium titanate (BST) ceramics are now being investigated in regards to various electronic applications.

BST ceramics exhibit a number of attributes which tend to make them useful for microwave phase shift applications. For instance, they exhibit a large variation of dielectric constant with changes in DC bias fields; low loss tangents over a range of operating DC bias voltages; insensitivity of dielectric properties to changes in environmental conditions; and are high reproducible. Nevertheless, they still exhibit very high dielectric constants which create substantial mismatches in phase shift environments.

Accordingly, it is an object of this invention to provide improved ferroelectric dielectrics that are suitable for use with electronic applications.

It is another object of this invention to provide improved BST dielectrics which exhibit low dielectric constants.

It is yet another object of this invention to provide low dielectric BST materials which retain a substantial tunability characteristic.

It is yet another object of this invention to provide improved BST materials that exhibit both low dielectric constants and operate in the paraelectric region at ambient temperatures.

SUMMARY OF THE INVENTION

An improved BST dielectric powder is created used a sol-gel procedure. Addition of graphite to the powder, followed by a firing of the mixture results in a highly porous BST substrate, with the included graphite being burned off. By adjustment of the amount of added graphite, the porosity of the BST substrate is widely adjustable and enables achievement of a low bulk dielectric constant. A low dielectric filler is added to the fired substrate so as to provide a composite substrate with physical rigidity. Conductive layers are then adhered to the composite substrate to enable a tuning of the dielectric constant in accordance with applied DC voltage potentials. Antenna and other applications of the improved composite BST substrate are described.

DETAILED DESCRIPTION OF THE INVENTION

It is to be understood hereinbelow, that while various BST compositions are described, the invention is equally applicable to other stoichiometric compositions, such as Lead Manganese Niobate (PMN), Lithium Niobate, Lead Lanthanum Zirconium Titanate (PLZT) etc. All of the aforementioned may be processed in accord with the invention to be described below and are tunable to varying degrees upon application of a bias voltage.

Figure 1:
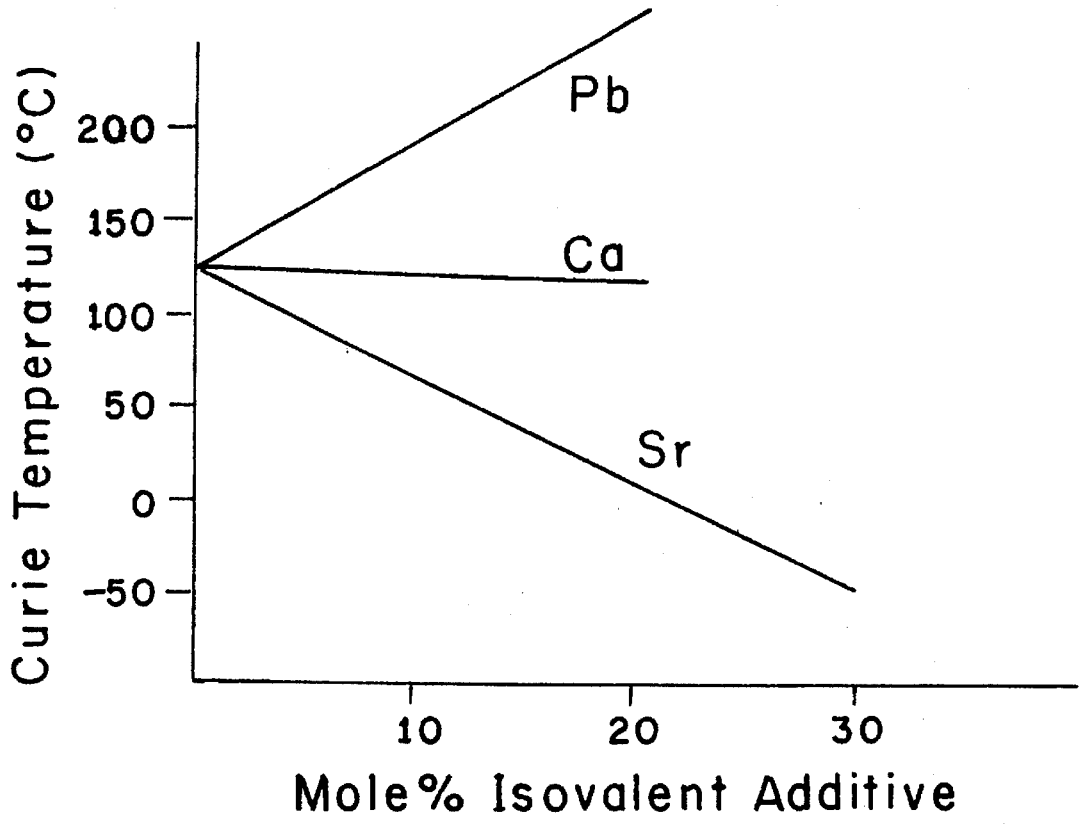
FIGURE 1 (Prior Art)
FIG. 1 is a plot of variation of Curie temperature of $BaTiO_3$ with changes in mole percent of isovalent additives.
Figure 2:
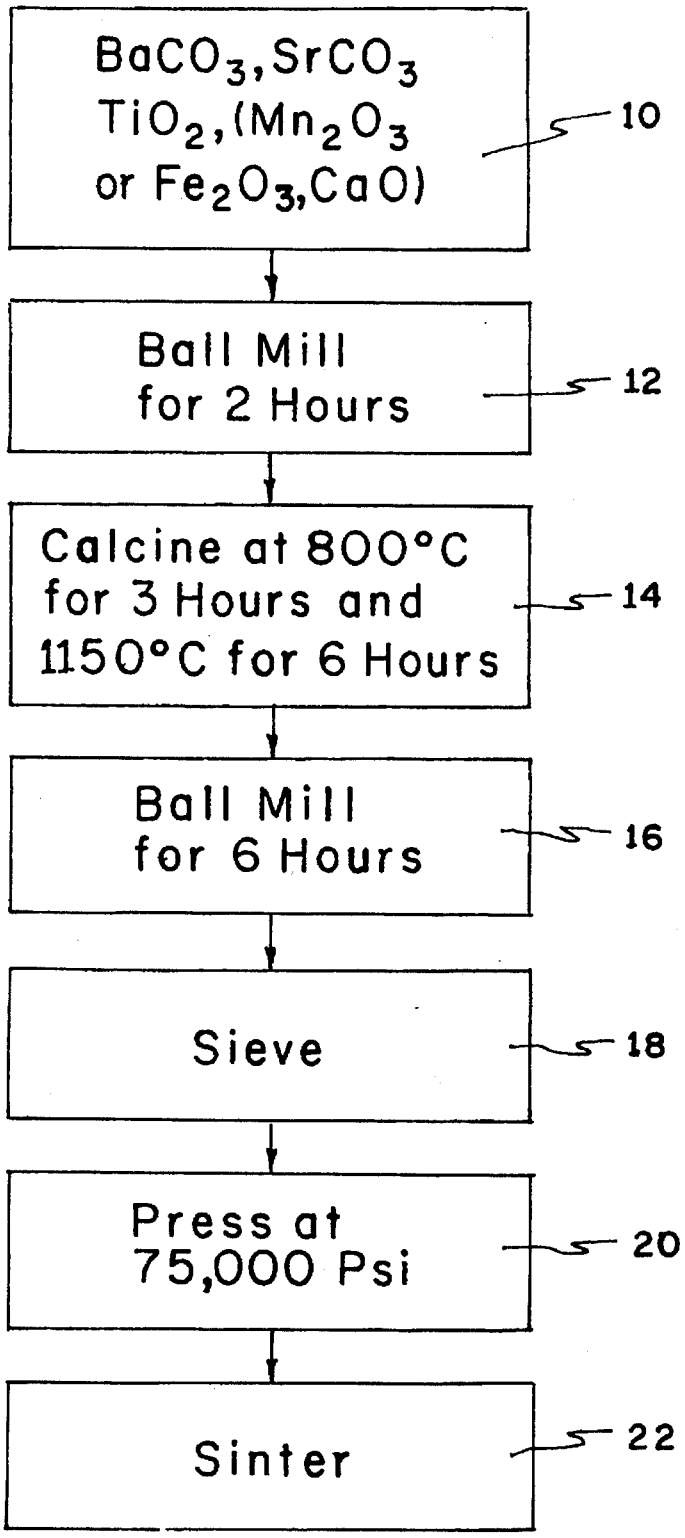
FIGURE 2 (Prior Art)
FIG. 2 is a flow chart of a prior art procedure for preparing $Ba_{1-x}Sr_xTiO_3$ powders.

A conventional method for the preparation of $Ba_{1-x}Sr_xTiO_3$ powders is shown in FIG. 2. The procedure commences, as shown at step 10, with a mixing of carbonates of barium and strontium with titanium dioxide. In addition, oxides of dopants may also be added (i.e., oxides of manganese, iron or calcium). The ingredients are then ball milled for two hours (step 12) and are then calcined at 800° C. for three hours and sintered at 1150° C. for 6 hours (box 14). The sintered materials are then ball milled for 6 more hours (step 16), sieved (step 18), and then pressed at 75,000 psi (step 20) to create a desired $Ba_{1-x}Sr_xTiO_3$ shape. Before the sieved powders are compressed in step 20, an organic binder (e.g. polyvinyl alcohol, alkaloid resin, etc.) is added in the form of a 10% solution to the calcined powder. The compacted powder shape is then sintered (step 22) to arrive at the final $Ba_{1-x}Sr_xTiO_3$ structure.

As above indicated, BST ceramics exhibit highly tunable dielectric constants which enable a substantial variation in an electrical phase shift therethrough. However, they also exhibit high dielectric values. Those values are so high as to cause a substantial mismatch when a BST ceramic is inserted into a signal transmission path. Such a mismatch results in a high standing wave ratio, unwanted reflections and resultant signal losses. It has been found that the dielectric constant of BST ceramics can be substantially altered by rendering the BST ceramic highly porous such that air and/or another low dielectric constant material can be interspersed with the BST material. Tunability is retained in such a lower dielectric BST ceramic—thereby enabling its use as a controllable phase shifter. Furthermore, such porous BST ceramics are usable not only as phase shifters but also as tunable capacitors in the form of both discrete thick films or distributed thin films.

It has also been found that use of a sol-gel method to manufacture BST ceramics, whether porous or solid, enables a uniform distribution of dopants therethrough—leading to a highly uniform composition distribution throughout the entire BST ceramic structure. Thus, for solid (dense) BST ceramics, the sol-gel method enables dopants to be uniformly distributed throughout the entire BST ceramic—as compared to a rather non-uniform distribution when made by the conventional process shown in FIG. 2.

Inclusion of graphite with a BST powder mixture (produced via the sol-gel process) enables production of a porous BST ceramic structure. Upon a subsequent firing at a slow rate, the included graphite is burned off—leaving the highly porous BST structure. The level of porosity (and the resulting density of the final ceramic) is controlled by the amount of added graphite. Sintering produces a porous BST ceramic which is then rendered mechanically strong by back-fill with an organic or inorganic filler.

The BST structure preferably includes appropriate levels of barium and strontium to assure that the resulting ceramic exhibits a Curie temperature that is at or below the lowest expected operating temperature. Under these conditions, the BST ceramic operates in its paraelectric region and hysteresis losses are avoided. To achieve such a BST ceramic, the strontium ratio should preferably be in a range of 15–50 mole percent.

Figure 3:
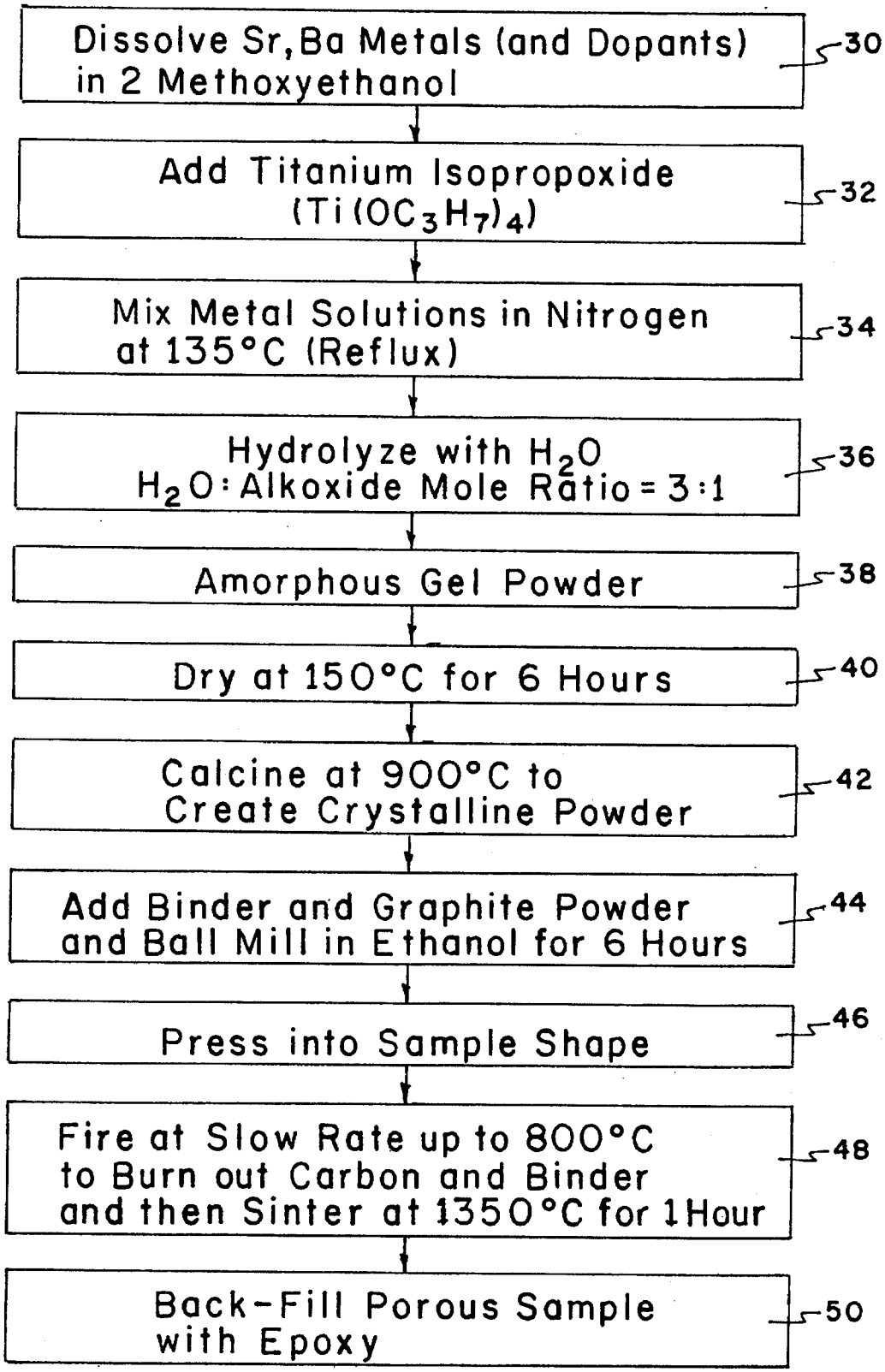
FIG. 3 is a flow chart of a process incorporating the invention hereof for producing both dense and porous BST samples.

Turning to FIG. 3, a sol-gel process will be described that enables achievement of porous BST ceramics which exhibit tunable, low-level dielectric constants; provides control of the Curie temperature to a level which assures paraelectric region operation; and insures that dopants added to the BST are uniformly distributed so as to provide the BST structure with a lowered dielectric loss tangent. Sol-gel processes are not, per se, novel, see "Sol-Gel Processes" Reuter "Advanced Materials", Vol. 3, No. 5, (1991), pp 258–259 and Vol. 3, No. 11, pp 568–571.

The procedure commences with step 30 wherein strontium and barium metals (and dopants, as required) are dissolved in 2-methoxyethanol. As dopants, manganese, iron or calcium in the form of nitrates or metals, may be added to the composition. The addition of strontium enables a reduction in the dielectric constant of the resulting BST ceramic, but the percentage reduction is small when compared to the reduction achieved through production of a porous BST shape.

Titanium isopropoxide ($Ti(OC_3H_7)_4$) is next added to the dissolved metal mixture (step 32) and the mixture is refluxed in nitrogen at 135° C. (step 34). The solution is then hydrolysed with triply distilled water wherein the $H_2O$:alkoxide mole ratio is 3:1 (step 36), with the result being an amorphous gel of BST powder (step 38). Next, the gel mixture is dried at 150° C. for 6 hours (step 40) and the resultant dried mixture is calcined at 900° C. to create a crystalline powder (step 42). Thereafter, a binder and graphite powder are added to the crystalline BST powder and the mixture is ball milled in ethanol for 6 hours (step 44). The ball milled mixture is then pressed into a desired shape (step 46), followed by firing at a slow rate up to 800° C. to burn out the graphite and binder (step 48).

Next, the shape is sintered at 1350° C. for one hour (step 50). The sintered shape is cooled and back filled with an organic or inorganic filler (e.g. an epoxy or a low loss oxide powder). The back filled BST shape is then cured to render the shape into a mechanically stable structure.

EXPERIMENTAL MEASUREMENTS AND RESULTS

Dielectric constants and loss tangents of different compositions of BST ceramics were measured at 1 MHz. Silver paint was applied on both sides of a sample for impedance measurements. Impedance of the samples was measured by an HP 4192A impedance analyzer. The dielectric constants and loss tangents were calculated from the impedance measurements.

Dielectric properties were also measured as a function of temperature. Samples were encapsulated within a thin layer of silicon rubber and placed in a mixture of methanol and liquid nitrogen bath, and the temperature was varied from −50° C. to +50° C. In order to investigate the electrical tunability of the BST materials for phase shift applications at high frequencies, dielectric constants and loss tangents of $Ba_{0.65}Sr_{0.35}TiO_3$ and $Ba_{0.5}Sr_{0.5}TiO_3$ materials were measured as a function of DC bias fields at 1 MHz.

Figure 4:
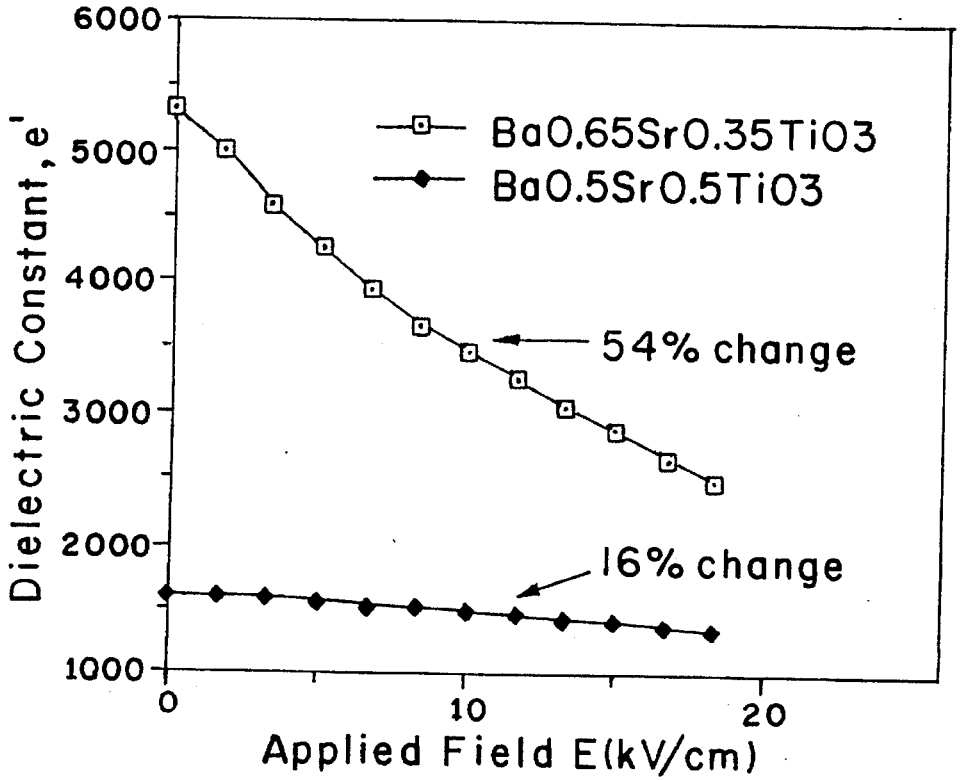
FIG. 4 is a plot of dielectric constant versus applied field for $Ba_{0.65}Sr_{0.35}TiO_3$ and $Ba_{0.5}Sr_{0.5}TiO_3$ solid samples, at 25° C. and 1 MHz.
Figure 5:
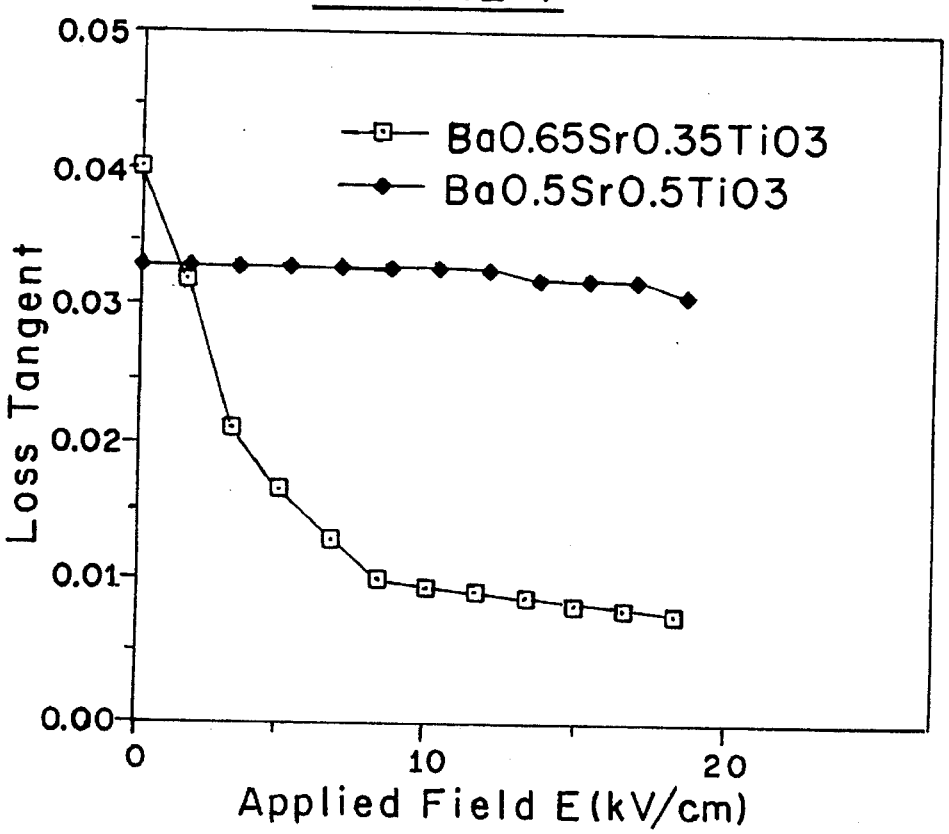
FIG. 5 is a plot of loss tangent versus applied field for $Ba_{0.65}Sr_{0.35}TiO_3$ and $Ba_{0.5}Sr_{0.5}TiO_3$ solid samples, at 25° C. and 1 MHz.

In FIG. 4, dielectric constants and loss tangents are shown for solid (dense) $Ba_{0.65}Sr_{0.35}TiO_3$ and $Ba_{0.5}Sr_{0.5}TiO_3$ samples produced via the sol-gel portion of the process of FIG. 3. The $Ba_{0.5}Sr_{0.5}TiO_3$ composition exhibits a change of about 16% in dielectric constant but little or no change in loss tangent (FIG. 5). By contrast, the $Ba_{0.65}Sr_{0.35}TiO_3$ composition shows a change of 54% in dielectric constant and a substantial decrease in loss tangent (FIG. 5).

Figure 6:
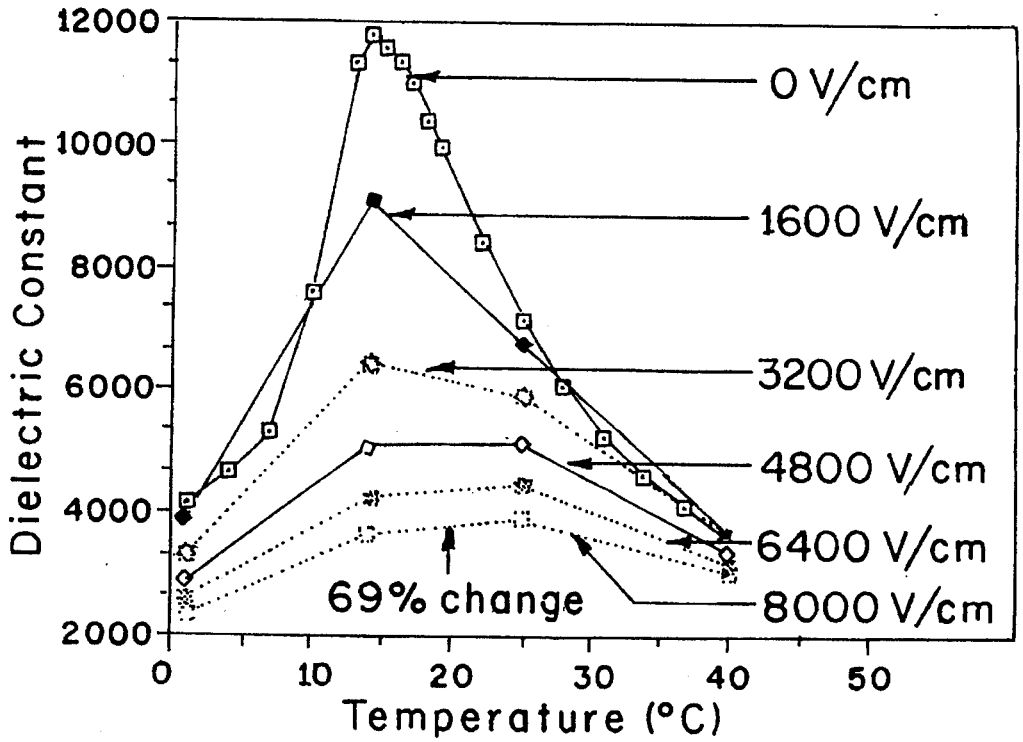
FIG. 6 is a plot of change of dielectric constant of solid $Ba_{0.65}Sr_{0.35}TiO_3$, versus temperatures and applied voltages at 1 MHz.
Figure 7:
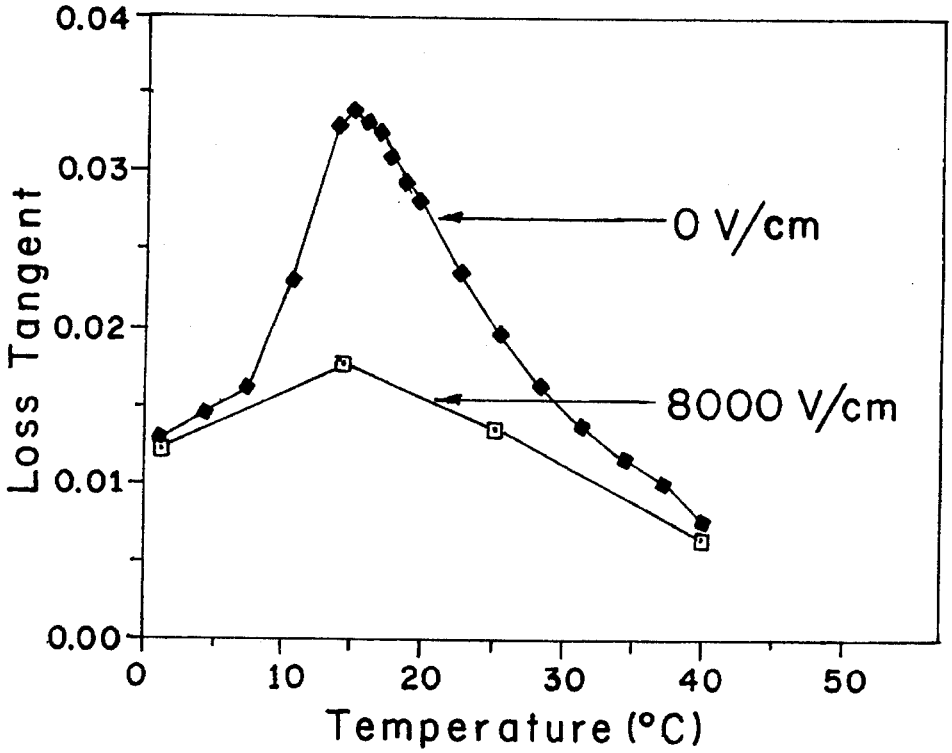
FIG. 7 is a plot of change of loss tangent of solid $Ba_{0.65}Sr_{0.35}TiO_3$, versus temperatures and applied voltages at 1 MHz.

The dielectric constant and loss tangent of solid (dense) $Ba_{0.65}Sr_{0.35}TiO_3$ samples were also measured as a function of voltage and temperature and are shown in FIGS. 6 and 7. FIG. 6 illustrates the change of dielectric constant of solid $Ba_{0.65}Sr_{0.35}TiO_3$ with temperature and applied voltage at 1 MHz. FIG. 7 plots the change of loss tangent of solid $Ba_{0.65}Sr_{0.35}TiO_3$ with temperatures and applied voltage at 1 MHz. When increasingly DC biased, the dielectric constant of the solid $Ba_{0.65}Sr_{0.35}TiO_3$ material decreases since the bias serves, increasingly, to repress domain reversibility.

Figure 8:
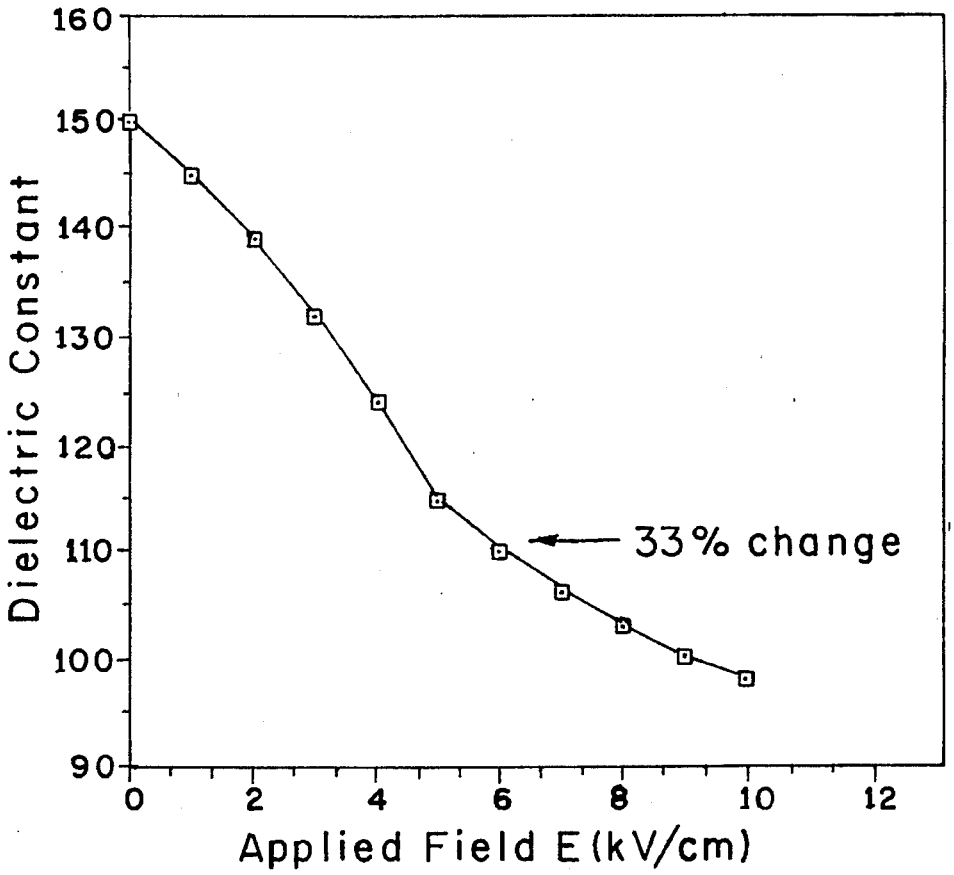
FIG. 8 is a plot of change of dielectric constant versus applied field for porous $Ba_{0.65}Sr_{0.35}TiO_3$ samples at 25° C. and 1 MHz.
Figure 9:
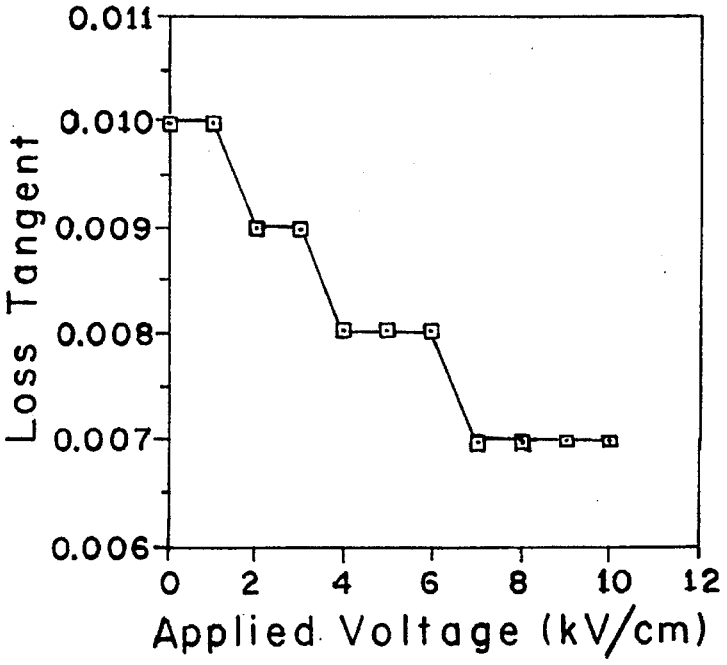
FIG. 9 is a plot of change of loss tangent of porous $Ba_{0.65}Sr_{0.35}TiO_3$, versus applied voltage at 1 MHz.
Figure 10:
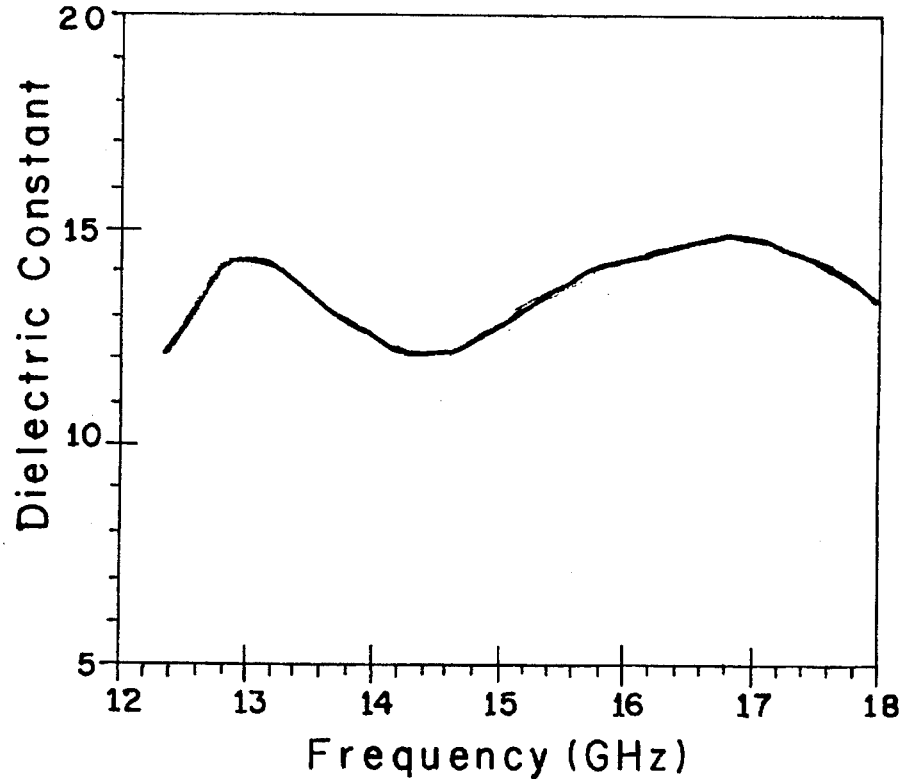
FIG. 10 is a plot of dielectric constant of porous $Ba_{0.65}Sr_{0.35}TiO_3$ as a function of microwave frequencies.
Figure 11:
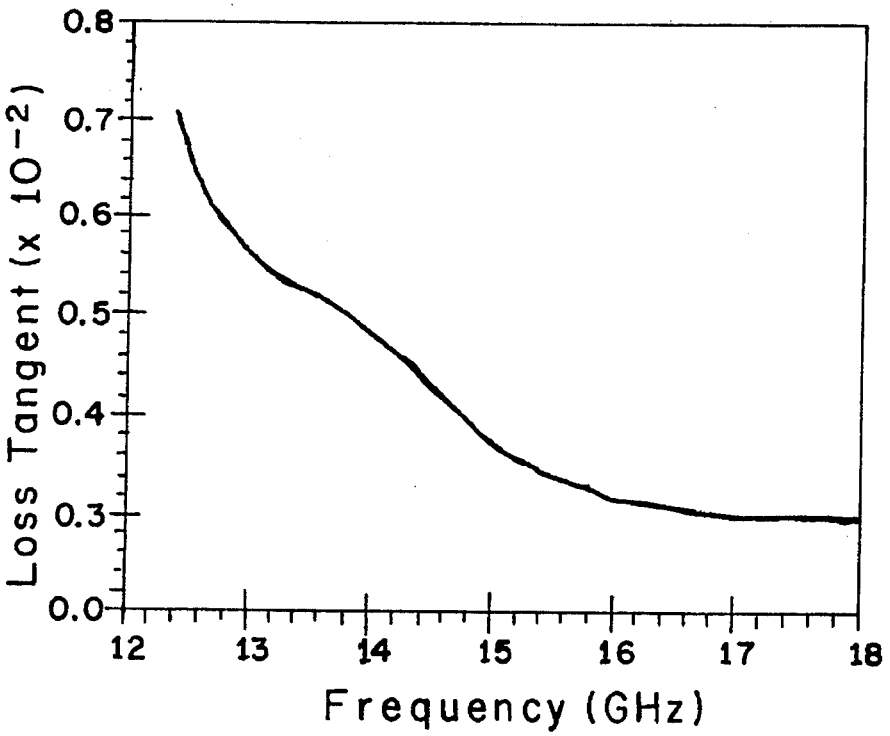
FIG. 11 is a plot of loss tangent of porous $Ba_{0.65}Sr_{0.35}TiO_3$ as a function of microwave frequencies.

The dielectric constants and loss tangents of porous $Ba_{0.65}Sr_{0.35}TiO_3$ samples produced by the sol-gel process of FIG. 3 were also measured at 1 MHz and at microwave frequencies. The dielectric constant and loss tangent of porous $Ba_{0.65}Sr_{0.35}TiO_3$ samples were approximately 150 (FIG. 8) and 0.007 (FIG. 9), respectively, with a tunability of around 33% at 10 kV/cm. The dielectric constant decreases to around 14 (FIG. 10) and the loss tangent varies from 0.007 to 0.003 (FIG. 11) in the frequency range of 12.4–18.0 GHz. The change of dielectric properties of $Ba_{0.65}Sr_{0.35}TiO_3$ is due to the relaxation that most ferroelectric materials exhibit at high frequency, when spontaneous polarization lags behind the applied frequency. Other dielectric properties as a function of density of $Ba_{0.65}Sr_{0.35}TiO_3$ are listed in Table 1 below.

TABLE 1

| AIR % | BST % | Dielectric Constant (1 MHz) | Loss tan | BIAS.FIELD (kV/cm) | TUN-ABILITY (%) |
|---|---|---|---|---|---|
| 70 | 30 | 150 | 0.008 | 10 | 33 |
| 75 | 25 | 51 | 0.008 | 50 | 30 |
| 80 | 20 | 30 | 0.006 | 40 | 8 |
| 85 | 15 | 17 | 0.001 | 60 | 5 |

It can be seen that as the percent of BST decreases, the tunability decreases and the level of bias field increases that is required to achieve the lower tunability. At approximately 75/25, a highly tunable BST ceramic results with a Curie point that is substantially lower than ambient. Furthermore, a dielectric constant of 51 results in a low loss tangent of 0.008. It is preferred that the BST % in the porous ceramic be no more than 50% to achieve the reduced dielectric constant.

ELECTRONICALLY STEERABLE "LEAKY-WAVE" ANTENNA

Figure 12:
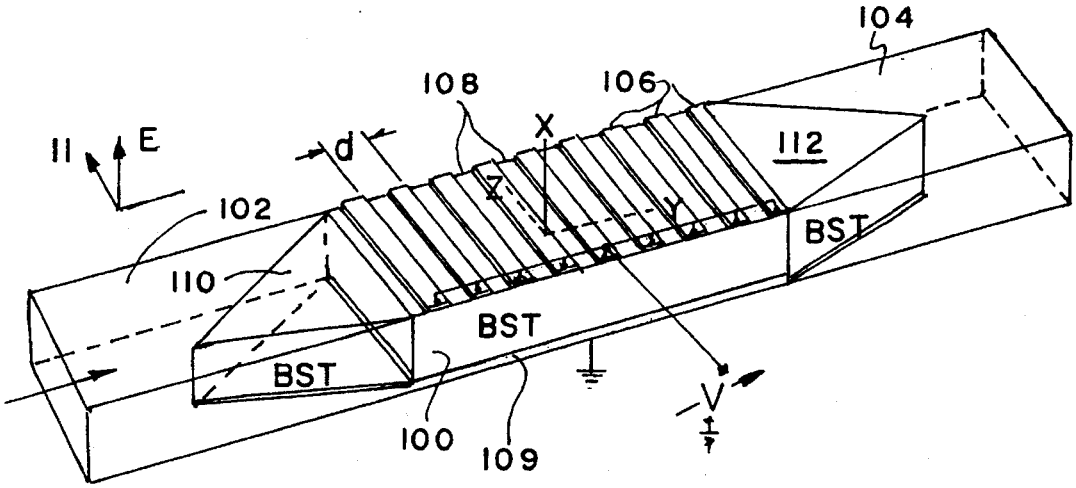
FIG. 12 is a perspective view of an electronically steerable "leaky-wave" antenna which employs a $Ba_{0.65}Sr_{0.35}TiO_3$ ceramic as a phase shift media.

Referring now to FIG. 12, an exemplary application of a porous BST ceramic produced via the sol-gel method is illustrated. In this instance, BST ceramic 100 is positioned between an inlet waveguide 102 and a matched load waveguide 104. A plurality of conductive strips 106 are positioned on the radiating surface of the antenna structure and are spaced so as to expose portions 108 of underlying BST ceramic 100. Each of conductive strips 106 is connected to a variable voltage source V which enables a tuning of the dielectric constant of BST ceramic 100. A conductive ground plane 109 forms a reference potential surface beneath BST ceramic 100. At either end of BST ceramic are additional BST formed shapes 110 and 112. Shape 110 prevents reflections by enabling an incoming wave front to gradually encounter the BST dielectric material. In a similar fashion, BST shape 112 enables a gradual transition from a BST to an air interface and from thence to an absorptive load (not shown).

An incoming wave in waveguide 102 is coupled into BST ceramic 100 and leaks out from between conductive strips 106. By varying voltage V between conductive strips 106 and ground plane 109, the electrical distance d between adjacent strips 106 can be varied as a result of the change in the dielectric constant of BST ceramic 100. As a result, a steering of the beam in the XY plane occurs. By properly varying voltage V, a substantial beam steering action can be achieved.

The use of the porous BST structure 100 both enables a relatively low dielectric constant to be exhibited that prevents reflections due to an air/dielectric mismatch at inlet waveguide 102. Furthermore, by assuring that the BST ceramic 102 has a Curie point at or below the operating temperature of the leaky wave antenna structure, operations occur in the paraelectric region, thereby reducing and/or eliminating hysteresis losses.

PHASED ARRAY ANTENNA

Figure 13:
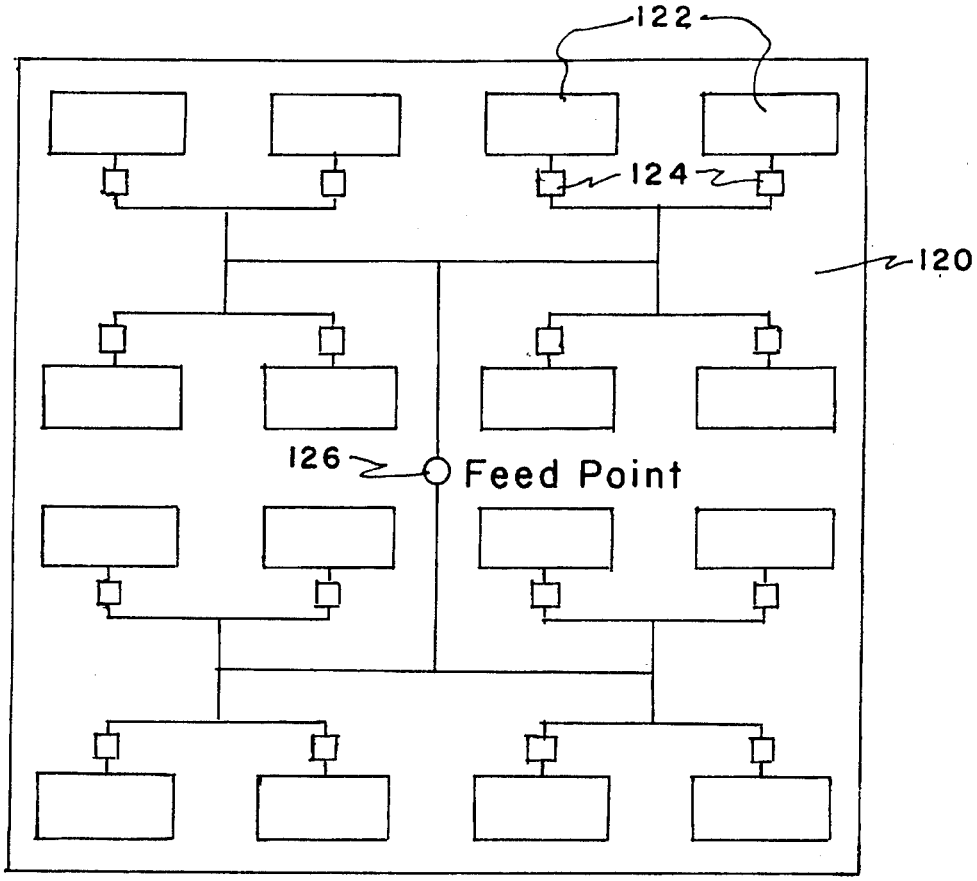
FIG. 13 is a schematic view of a phased array antenna which makes use of $Ba_{0.65}Sr_{0.35}TiO_3$ phase shifters.

In FIG. 13, a schematic of a microstrip, electronically steerable, phased array antenna 120 is shown wherein each of antenna elements 122 is connected via a BST phase shifter 124 and a microstrip connecting line to a feed point 126. Each of BST phase shifters 124 is connected to a steering voltage source (not shown) which enables the bias thereacross to be varied so as to change the phase shift of a signal being fed from feed point 126 to antenna elements 122. BST phase shifters 124, simply by change of a DC voltage thereacross, enable a controllable phase shift to be imparted to a signal that is either fed to or sensed from antenna elements 122. In such manner, antenna elements 122 are enabled to exhibit a beam scan function known to those skilled in the art.

Other applications of the BST material are: as a tunable dielectric to enable an electrical distance from a ground plane to be varied in accordance with an applied DC bias; in radome structures to enable the radome to selectively exhibit asymmetric transmissivities; for use in tunable multilayer capacitors; various additional antenna applications; as tunable substrates for printed circuit boards where the board forms an active element in the circuit; for use with chiral composites to enable a tuning of absorptive characteristics thereof; for use as a high energy cell or battery; in combination with IR windows, electrochronic coatings; and in micro-electro mechanical sensor applications, etc.

It should be understood that the foregoing description is only illustrative of the invention. Various alternatives and modifications can be devised by those skilled in the art without departing from the invention. As indicated above, PMN, PLZT and other ferroelectric compositions may be substituted for BST. The Curie temperatures thereof may be varied by alteration therein of one or more constituents (e.g. zirconium in PLZT, manganese in PMN, etc.). Accordingly, the present invention is intended to embrace all such alternatives, modifications and variances which fall within the scope of the appended claims.

What is claimed is:

1. An antenna comprising:

means for feeding an electromagnetic signal:

a radiating surface;

a dielectric phase shift structure positioned between said means for feeding and said radiating surface, said dielectric phase shift structure comprising a porous ceramic matrix including barium strontium titanate, said barium and strontium present in a percentage to assure a Curie temperature for said porous ceramic matrix below an operating temperature of said antenna, said porous ceramic matrix comprising not more than 50% of a volume of said dielectric phase shift structure; and bias means positioned in contact with said structure for enabling an alteration of a dielectric constant of said structure by application of a voltage level.

2. The antenna as recited in claim 1, wherein said dielectric phase shift structure comprises a unitary block, said unitary block including on one surface thereof a ground plane and on an opposed surface thereof, a plurality of spaced electrodes, said ground plane and spaced electrodes comprising said bias means.

3. The antenna structure as recited in claim 2, further comprising:

at least one formed shape of said porous ceramic matrix juxtaposed to said unitary block at a point where said unitary block mates with said means for feeding, said formed shape of said porous ceramic matrix enabling an incoming wavefront to gradually encounter said porous ceramic matrix to thereby provide a gradual transition from an air interface to said porous ceramic matrix.

* * * * *